US009959970B2

(12) United States Patent
Yang

(10) Patent No.: US 9,959,970 B2
(45) Date of Patent: May 1, 2018

(54) RESONANT HIGH CURRENT DENSITY TRANSFORMER WITH IMPROVED STRUCTURE

(71) Applicant: YUJING TECHNOLOGY CO., LTD., Taoyuan (TW)

(72) Inventor: Sen-Tai Yang, Taoyuan (TW)

(73) Assignee: YUJING TECHNOLOGY CO., LTD., Taoyuan (TW)

( * ) Notice: Subject to any disclaimer, the term of this patent is extended or adjusted under 35 U.S.C. 154(b) by 0 days. days.

(21) Appl. No.: 15/370,394

(22) Filed: Dec. 6, 2016

(65) Prior Publication Data

US 2018/0061557 A1 Mar. 1, 2018

(30) Foreign Application Priority Data

Aug. 24, 2016 (TW) ..... 105127103 A

(51) Int. Cl.
*H01F 27/24* (2006.01)
*H01F 27/30* (2006.01)
(Continued)

(52) U.S. Cl.
CPC ..... *H01F 27/2847* (2013.01); *H01F 27/26* (2013.01); *H01F 27/289* (2013.01);
(Continued)

(58) Field of Classification Search
CPC ..... H01F 27/24; H01F 27/28; H01F 27/325
(Continued)

(56) References Cited

U.S. PATENT DOCUMENTS 6,154,113 A * 11/2000 Murai ..... H01F 27/2828 336/192
6,794,976 B2 * 9/2004 Sigl ..... H01F 27/38 219/670

(Continued)

*Primary Examiner* — Ronald Hinson
(74) *Attorney, Agent, or Firm* — Pro-TECHTOR International Services; Ian Oglesby

(57) ABSTRACT

A resonant high current density transformer with an improved structure includes a secondary insulating bobbin, a primary insulating bobbin and a core assembly. The secondary insulating bobbin includes a base. Two posts extend from a first side of the base, and a raised plate extends from a second side of the base, the second side is opposite to the first side. The two posts and the raised plate form a receiving space for receiving an insulating sheath having a plurality of sleeves. A secondary winding is provided on each of the sleeve. The primary insulating bobbin having a tunnel is provided at one side of the secondary insulating bobbin. The surface of the primary insulating bobbin is provided with a primary winding and covered by an insulating cover. A core assembly includes a first core and a second core. A first primary core column and a second primary core column opposite to each other extend from a side of the first and second cores, respectively, and a plurality of first secondary core columns and a plurality of second secondary core columns extend from another side of the first and second cores, respectively. The first primary core column and the second primary core column are inserted into the tunnel of the primary insulating bobbin, while each of the first secondary core columns and each of the second secondary core columns are inserted into a corresponding one of the sleeves. As a result, the secondary windings are capable of withstanding large current. Their overall length covers the air gap of the core assembly, thus achieving magnetic shielding. Meanwhile, production and assembly processes are simplified.

11 Claims, 5 Drawing Sheets

(51) Int. Cl.

| | |
|---|---|
| ***H01F 27/26*** | (2006.01) |
| ***H01F 27/28*** | (2006.01) |
| ***H01F 27/32*** | (2006.01) |
| ***H01F 27/33*** | (2006.01) |
| ***H01F 27/34*** | (2006.01) |

(52) U.S. Cl.
CPC ..... *H01F 27/325* (2013.01); *H01F 27/33* (2013.01); *H01F 27/34* (2013.01)

(58) Field of Classification Search
USPC ..... 336/212
See application file for complete search history.

(56) References Cited

U.S. PATENT DOCUMENTS

| | | | | |
|---|---|---|---|---|
| 7,365,630 | B1 * | 4/2008 | Yang | H01F 3/12 336/198 |
| 8,022,803 | B2 * | 9/2011 | Park | H01F 27/325 336/136 |
| 8,896,404 | B2 * | 11/2014 | Won | H01F 5/02 336/182 |
| 2008/0278274 | A1 * | 11/2008 | Kang | H01F 27/06 336/198 |
| 2009/0066290 | A1 * | 3/2009 | Altekruse | H01F 27/325 320/108 |
| 2009/0184792 | A1 * | 7/2009 | Yang | H01F 27/266 336/65 |
| 2009/0309684 | A1 * | 12/2009 | Tsai | H01F 27/2866 336/105 |

* cited by examiner

RESONANT HIGH CURRENT DENSITY TRANSFORMER WITH IMPROVED STRUCTURE

BACKGROUND OF THE INVENTION

1. Field of the Invention

The invention relates to transformers, and more particularly, to a resonant high current density transformer with an improved structure that allows high current to pass through while increasing magnetic shielding at the secondary side, at the same time allows simplified production and assembly processes.

2. Description of the Prior Art

In power supply systems for electronic products such as LCD TVs, a main type of transformers used are transformers with leakage inductance property (such as LLC transformers) in order to reduce switching losses and noise.

In TW Patent Publication No. 201619991 titled "Resonant High Current Density Transformer", the transformer mainly includes: two cores, each including first and second side posts extending in the same direction from two sides thereof, wherein the two cores abut against each other with the two first side posts facing each other and the two second side posts facing each other; a first bobbin provided with a penetrating first through-hole that envelops the first side posts on the same side of the two cores, wherein a side plate is provided on the outer periphery of either end of the first through-hole, and a spacer is provided on the first bobbin between the two side plates on the outer periphery of the first through-hole, and two coil slots are formed on the two sides of the spacer, respectively; a primary winding formed by winding wires around the two coil slots of the first bobbin; a second bobbin provided with a penetrating second through-hole that envelops the second side posts on the same side of the two cores, wherein the second bobbin is provided with a spacer on the mid-section of the outer periphery of the second through-hole, and two winding regions and are formed on the two sides of the spacer, respectively; two metal plates bent to envelop the outer peripheries of the two winding regions of the second bobbin to form a secondary winding; a bobbin mount disposed at the external flank of the second bobbin, the bobbin mount including a base provided with a barrier plate on a side closer to the first bobbin, wherein the barrier plate is used for separating the first and second bobbins; and an insulating "U-shape" separating cover provided on a side of the first bobbin closer to the bobbin mount, wherein the two ends of the separating cover cover the top and bottom sides of the first bobbin, respectively.

However, the above transformer design still has the following shortcomings:

1. Although metal plates are used instead of secondary windings in the patent application above, the purpose of the secondary windings is to allow large current to pass through. When the power required for the transformer increases, the current will also increase. This means that the cross-sectional areas of the cores must also be increased to accommodate the required power increase. Thus, this hinders the reduction in the size of the transformer.

2. The metal plates in the patent application above bend down to envelope the outer peripheries of the two winding regions of the second bobbin and are separated by a spacer. The sum of the widths of the two metal plates and the width of the spacer equals the width of the primary winding on the first bobbin, and the spacer is not magnetically permeable, thus creating an air gap between the two metal plates, which leads to air gap losses.

3. The two metal plates and the second side posts of the cores in the above patent application are arranged perpendicular to each other, thus generating unnecessary magnetic shielding between the metal plates and the second side posts, increasing copper losses.

In view of the shortcomings in the conventional transformer structures, the present invention is proposed to provide improvements that address these shortcomings.

SUMMARY OF THE INVENTION

One main objective of the present invention is to provide a resonant high current density transformer with an improved structure that allows large current to pass through by employing copper plates as secondary windings.

Another objective of the present invention is to provide a resonant high current density transformer with an improved structure that, by having multiple cores at the secondary side, is capable of adjusting the number of parallel cores according to the magnitude of the power.

Yet another objective of the present invention is to provide a resonant high current density transformer with an improved structure that simplifies the production and assembly processes.

In order to achieve the above objectives and efficacies, the technical means employed by the present invention may include: a secondary insulating bobbin, a primary insulating bobbin and a core assembly.

The secondary insulating bobbin may include a base, two posts extending from a first side of the base, and the two posts are in proximity to the two ends of the first side, respectively, and a raised plate on a second side of the base, the second side being opposite to the first side, and the raised plate positioned relatively between the two posts. A receiving space is formed between the two posts and the raised plate for receiving an insulating sheath with a plurality of sleeves. A secondary winding surrounds each of the sleeves.

The primary insulating bobbin may including a penetrating tunnel. The surface of the primary insulating bobbin is provided with a primary winding and covered by an insulating cover.

The core assembly may include a first core and a second core. A first primary core column and a plurality of first secondary core columns extend from the first core, and a second primary core column and a plurality of second secondary core columns extend from the second core. The first core and the second core are assembled inside the secondary insulating bobbin and the primary insulating bobbin, respectively, and the first primary core column and the second primary core column are inserted inside the tunnel of the primary insulating bobbin, and each of the first secondary core columns and each of the second secondary core columns is inserted into a corresponding insulating sheath of the secondary insulating bobbin.

Based on the above structure, a ring piece is provided on either end of the primary insulating bobbin, and one or more partitioning ring pieces are provided on the surface of the primary insulating bobbin between the two ring pieces.

Based on the above structure, a fastening strip extends from either side of the insulating cover and is fastened between one of the ring pieces and one of the partitioning ring pieces.

Based on the above structure, each of the ring pieces includes an insulating block, each of the ring pieces includes an engaging face, and the engaging faces surrounding the surfaces of the first primary core column and the second primary core column.

Based on the above structure, the base of the secondary insulating bobbin is provided with a plurality of through holes, and the ends of the secondary windings pass through the through holes.

Based on the above structure, an engaging face is provided on a side of each of the posts facing the raised plate, the engaging faces surrounding the surfaces of the first secondary core columns and the second secondary core columns.

Based on the above structure, a securing plate is extended from the top of the insulating sheath covering the secondary windings.

Based on the above structure, the secondary windings are copper plates bent at either ends.

Based on the above structure, the number of the plurality of sleeves of the insulating sheath equals the number of the first secondary core columns and the second secondary core columns.

Based on the above structure, the secondary insulating bobbin and the primary insulating bobbin are coupled by a coupling mechanism.

Based on the above structure, the coupling mechanism includes a securing clip that is assembled across the core assembly, and a connecting portion and a matching portion provided opposite to each other on the secondary insulating bobbin and the primary insulating bobbin, respectively.

The objectives, efficacies and features of the present invention can be more fully understood by referring to the drawing as follows:

DETAILED DESCRIPTION OF THE PREFERRED EMBODI-MENTS

Figure 1:
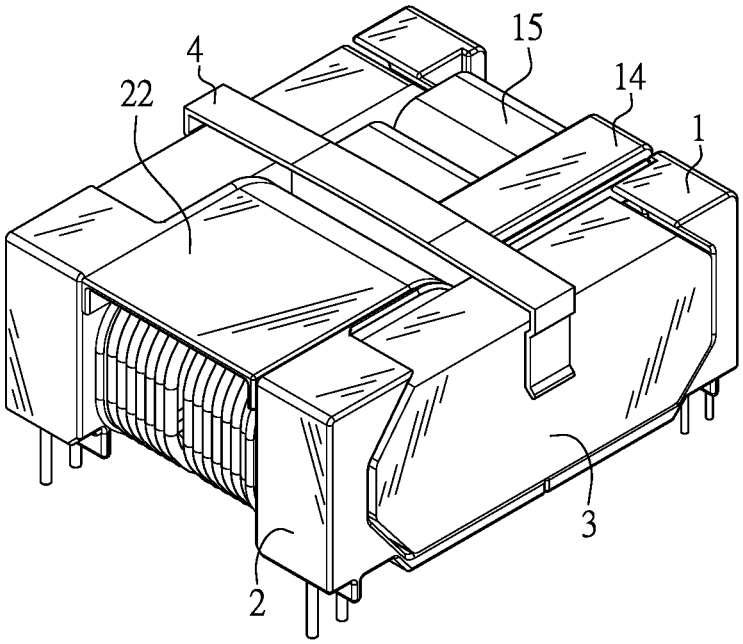
FIG. 1 is an isometric view of a preferred embodiment of the present invention.
Figure 2:
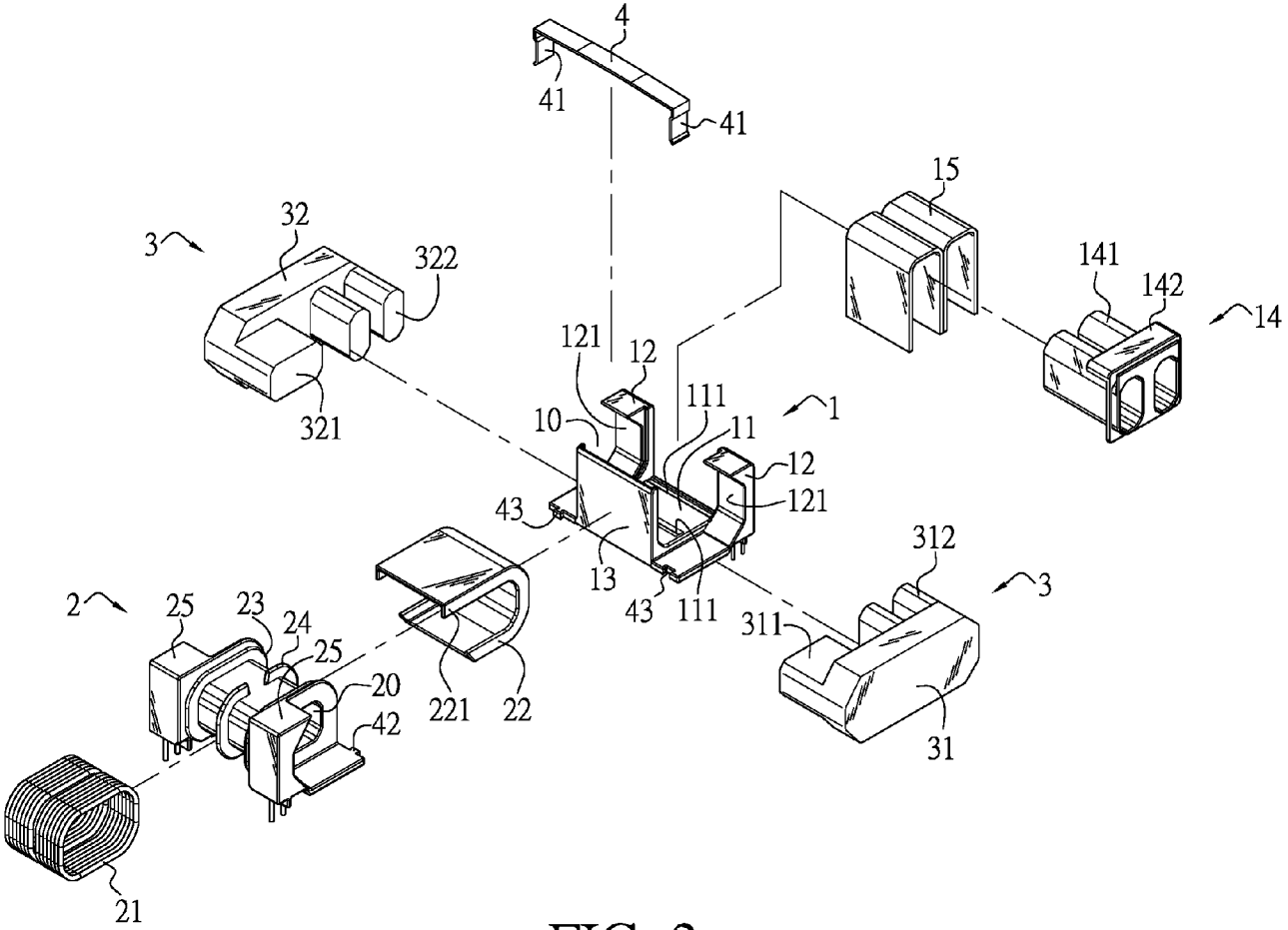
FIG. 2 is an exploded isometric view of the preferred embodiment of the present invention.
Figure 3:
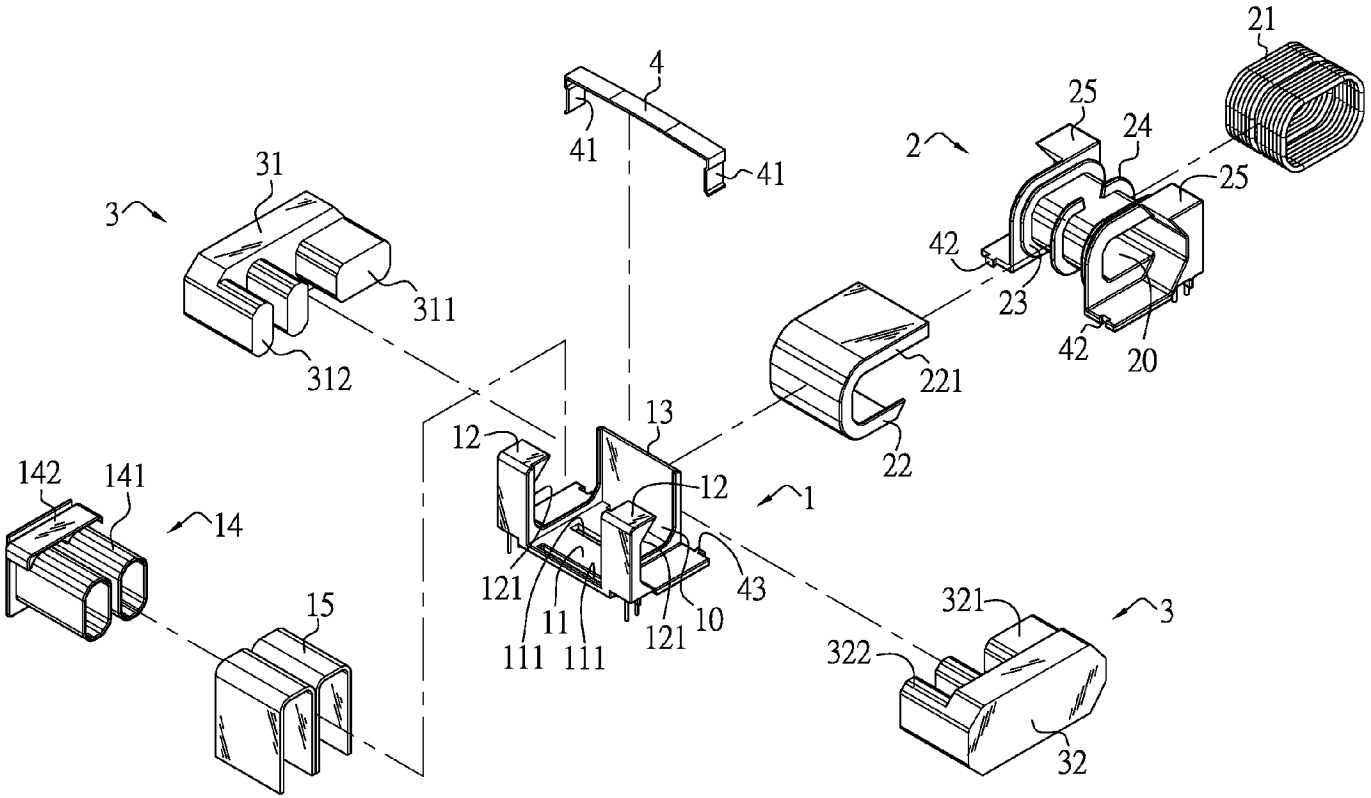
FIG. 3 is an exploded isometric view of the preferred embodiment of the present invention from another perspective.
Figure 4:
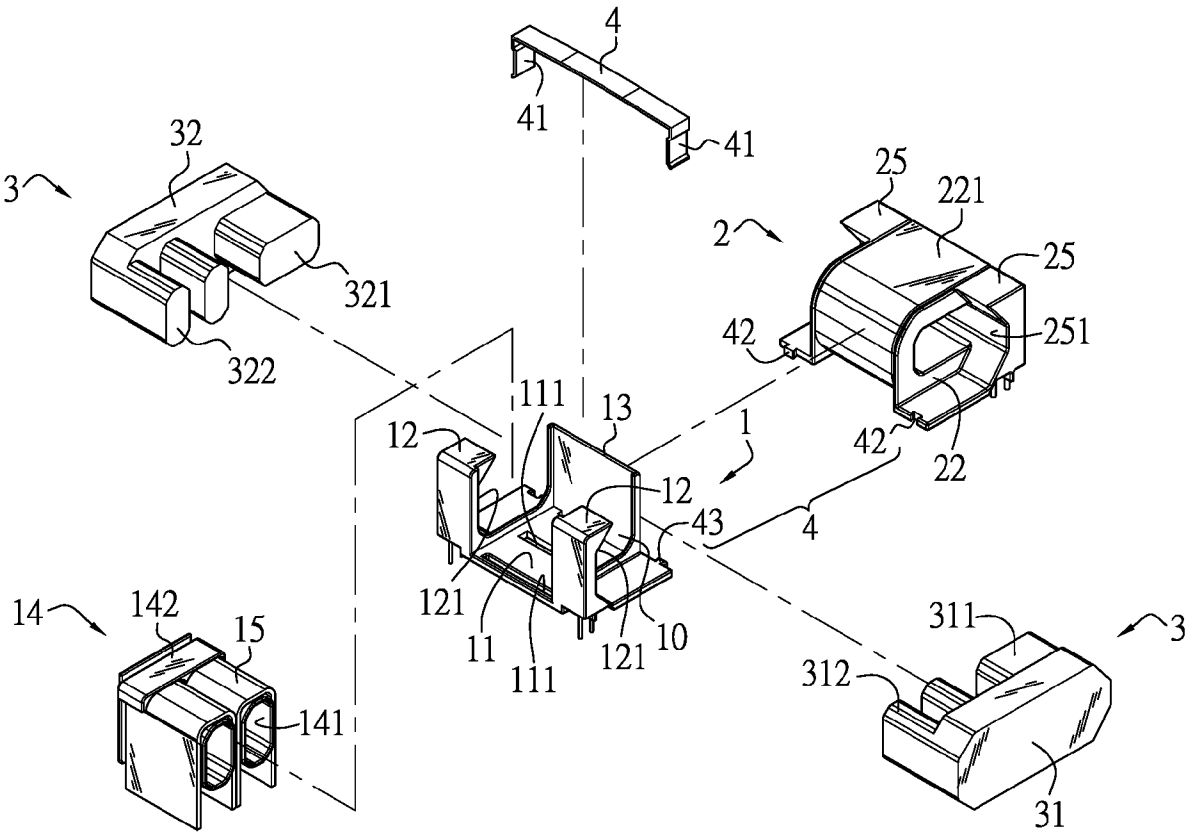
FIG. 4 is an isometric view of the preferred embodiment of the present invention with partial assembly.
Figure 5:
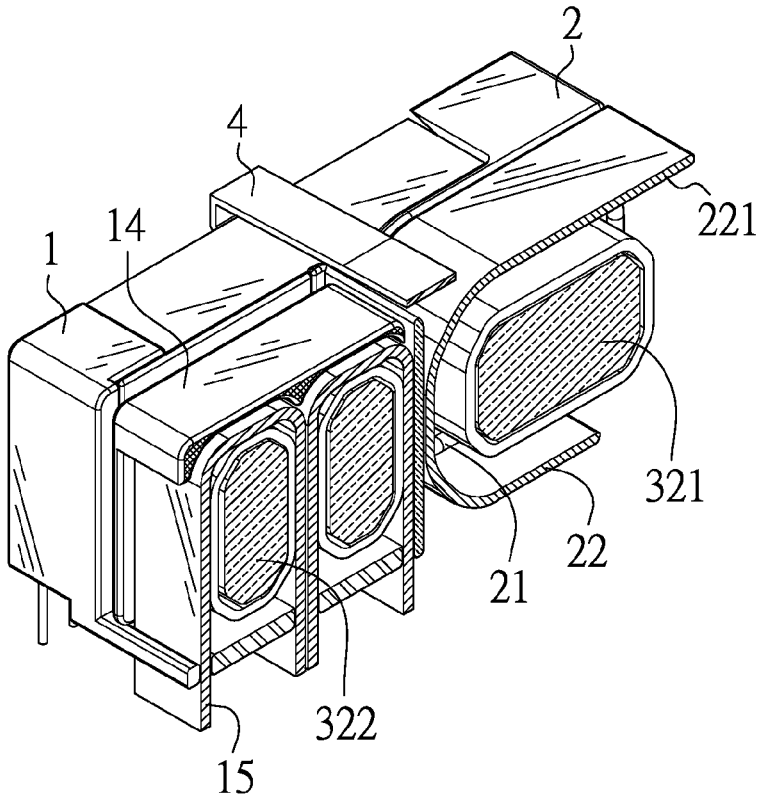
FIG. 5 is a cross-sectional view of the preferred embodiment of the present invention.

Referring to FIGS. 1 to 5, it can be understood that the structure of the present invention mainly includes the following.

A secondary insulating bobbin 1 with a base 11 is provided. The base 11 is provided with a plurality of through holes 111. Two posts 12 extend from a first side of the base 11, and the two posts 12 are in proximity to the two ends of the first side, respectively. A raised plate 13 extends from a second side of the base 11, the second side being opposite to the first side, and the raised plate is positioned relatively between the two posts 12. The two posts 12 and the raised plate 13 together form a receiving space 10 for receiving an insulating sheath 14 with a plurality of sleeves 141. A securing plate 142 is extended from the top of the sleeves 141. A secondary winding 15 is provided on each of the sleeves 141. The secondary windings 15 are covered by the securing plate 142. An engaging face 121 is provided on a side of each of the posts 12 opposite the raised plate 13. It should be noted that, in order to allow large current to pass through while reducing copper losses, the secondary winding 15 are made of copper plates that are bent at both ends, so that the copper plates are parallel to the direction of the magnetic field to achieve partial magnetic shielding.

A primary insulating bobbin 2 is provided at the side of the secondary insulating bobbin 1 where the raised plate 13 is. The primary insulating bobbin 2 includes a penetrating tunnel 20 and a ring piece 23 provided on either end thereof One or more partitioning ring pieces 24 are provided on the surface of the primary insulating bobbin 2 between the two ring pieces 23. A primary winding 21 can be coiled around the surface of the primary insulating bobbin 2, and are divided into multiple slots by the ring pieces 23 and the plurality of partitioning ring pieces 24. An insulating cover 22 partially surrounds the primary winding 21. A fastening strip 221 extends from either side of the insulating cover 22. The fastening strip 221 is jammed between a ring piece 23 and a partitioning ring piece 24. Furthermore, an insulating block 25 extends from each of the ring pieces 23. Each of the insulating block 25 includes an engaging face 251.

A core assembly 3 includes a first core 31 and a second core 32. A first primary core column 311 extends from one end of the first core 31, and a plurality of first secondary core columns 312 extend from the other end of the first core 31. Similarly, a second primary core column 321 extends from one end of the second core 32, and a plurality of second secondary core columns 322 extend from the other end of the second core 32. The first core 31 and the second core 32 are assembled inside the secondary insulating bobbin 1 and the primary insulating bobbin 2, respectively, wherein the first primary core column 311 and the second primary core column 321 are inserted inside the tunnel 20 of the primary insulating bobbin 2, and each of the first secondary core columns 312 and the second secondary core columns 322 is inserted into a corresponding insulating sheath 14 of the secondary insulating bobbin 1, respectively.

A coupling mechanism 4 is used for coupling the secondary insulating bobbin 1, the primary insulating bobbin 2 and the core assembly 3 together. The coupling mechanism 4 includes a securing clip 41 that is assembled across the top of the core assembly 3, and a connecting portion 42 and a matching portion 43 provided opposite to each other on the primary insulating bobbin 2 and the secondary insulating bobbin 1, respectively. In a preferred embodiment, the connecting portion 42 and the matching portion 43 are the pin and the tail of a dovetail joint.

In the assembly process, the secondary windings 15 are inserted into the plurality of sleeves 141 of the insulating sheath 14, respectively. The secondary windings 15 are fastened in place by the securing plate 142 of the insulating sheath 14 to prevent the secondary windings 15 from slipping off the sleeves 141. Then, the insulating sheath 14 with the inserted secondary windings 15 is put into the receiving space 10 of the secondary insulating bobbin 1. Since there are a plurality of through holes 111 on the base 11 of the secondary insulating bobbin 1, the ends of the secondary windings 15 can pass through the through holes 111, thereby securing the secondary winding 15 them in place. The primary winding 21 is wound onto the surface of the primary insulating bobbin 2 according to the multiple-slot structure formed by the ring pieces 23 and the partitioning ring pieces 24 of the primary insulating bobbin 2. Thereafter, the fastening strip 221 on either side of the insulating cover 22 is fixed between a ring piece 23 and a partitioning ring piece 24. Subsequently, the connecting portion 42 and the matching portion 43 of the primary insulating bobbin 2 and the secondary insulating bobbin 1 are joined together so as to couple the secondary insulating bobbin 1 and the primary insulating bobbin 2 together. It should be noted that, when the connecting portion 42 is provided on the primary insulating bobbin 2, the matching portion 43 is provided on the secondary insulating bobbin 1. On the other hand, when the connecting portion 42 is provided on the secondary insulating bobbin 1, the matching portion 43 is provided on the primary insulating bobbin 2. Then, the first primary core column 311 of the first core 31 is inserted into the tunnel 20 of the primary insulating bobbin 2, whereas each of the first secondary core columns 312 of the first core 31 is inserted into a respective sleeve 141 of the insulating sheath 14 in the secondary insulating bobbin 1; similarly, the second primary core column 321 of the second core 32 is inserted into the tunnel 20 of the primary insulating bobbin 2, whereas each of the second secondary core columns 322 of the second core 32 is inserted into a respective sleeve 141 of the insulating sheath 14 in the secondary insulating bobbin 1, so that the first primary core column 311 is in contact with the second primary core column 321 inside the tunnel 20, whereas the first secondary core columns 312 and the first primary core column 311 are in contact with each other inside the tunnel 20, allowing a magnetic circuit to be formed. It should be noted that, after the first core 31 and the second core 32 are inserted into the secondary insulating bobbin 1 and the primary insulating bobbin 2, the engaging faces 121 on the posts 12 of the secondary insulating bobbin 1 wrap around the side surfaces of the first secondary core column 312 and the second secondary core column 322 closest to the posts 12, while the engaging faces 251 on the insulating blocks 25 on the ring pieces 23 of the primary insulating bobbin 2 wrap around the side surfaces of the first primary core column 311 and the first secondary core columns 312, so that the first primary core column 311, the first secondary core columns 312, the second primary core column 321 and the second secondary core columns 322 are protected from external force and contamination, as well as interference of external noise.

It should be noted that the first core 31 and the second core 32 are provided with a plurality of first secondary core columns 312 and the second secondary core columns 322, respectively, the insulating sheath 14 is also provided with the same number of sleeves 141, and the secondary windings 15 are provided in equal number to the sleeves 141. Thus, the present invention is capable of adjusting the number of the parallel first secondary core columns 312 and the parallel second secondary core columns 322 according to the magnitude of the required output power (i.e. the actual production requirement). Furthermore, the cross-sectional area of each of the cores can also be adjusted to control the current flowing through it. In this present application, for illustration purpose, two first secondary core columns 312 and two second secondary core columns 322 are shown. Nonetheless, the number of the secondary core columns is not limited thereto. As mentioned before, each of the secondary windings 15 is a copper plate bent down at either end to surround a corresponding first secondary core column 312 and a corresponding second secondary core column 322. The width of the secondary winding 15 can completely occupy the first secondary core columns 312 and the second secondary core columns 322. In the case that width is sufficient, the thickness can be reduced to further decrease the eddy current losses. The space in which the first secondary core columns 312 and the second secondary core columns 322 occupy can be fully utilized. As a result, minimization can be achieved.

In view of this, the resonant high current density transformer of present invention is submitted to be novel and non-obvious, and a patent application is hereby filed in accordance with the patent law. It should be noted that the descriptions given above are merely descriptions of preferred embodiments of the present invention, various changes, modifications, variations or equivalents can be made to the invention without departing from the scope or spirit of the invention. It is intended that all such changes, modifications and variations fall within the scope of the following appended claims and their equivalents.

What is claimed is:

1. A resonant high current density transformer with an improved structure comprising:

a secondary insulating bobbin including a base, two posts extending from either end of one side of the base at locations in proximity to the two ends of the first side, respectively, a raised plate extending from a second side of the base, the second side being opposite to the first side, the raised plate being positioned relatively between the two posts, a receiving space formed between the two posts and the raised plate for receiving an insulating sheath with a plurality of sleeves, and a secondary winding surrounding each of the sleeves;

a primary insulating bobbin provided at the side of the secondary insulating bobbin that is closer to the raised plate and including a penetrating tunnel, the surface of the primary insulating bobbin being provided with a primary winding and covered by an insulating cover; and a core assembly including a first core and a second core, and a first primary core column and a plurality of first secondary core columns extending from the first core, and a second primary core column and a plurality of second secondary core columns extending from the second core, wherein the first core and the second core are assembled inside the secondary insulating bobbin and the primary insulating bobbin, respectively, and the first primary core column and the second primary core column are inserted inside the tunnel of the primary insulating bobbin, and each of the first secondary core columns and each of the second secondary core columns is inserted into a corresponding insulating sheath of the secondary insulating bobbin.

2. The resonant high current density transformer with an improved structure of claim 1, wherein each of the ring pieces includes an insulating block, each of the ring pieces includes an engaging face, and the engaging faces surrounding the surfaces of the first primary core column and the second primary core column.

3. The resonant high current density transformer with an improved structure of claim 1, wherein the base of the secondary insulating bobbin is provided with a plurality of through holes, and the ends of the secondary windings pass through the through holes.

4. The resonant high current density transformer with an improved structure of claim 1, wherein an engaging face is provided on a side of each of the posts facing the raised plate, the engaging faces surrounding the surfaces of the first secondary core columns and the second secondary core columns.

5. The resonant high current density transformer with an improved structure of claim 1, wherein a securing plate is extended from the top of the insulating sheath covering the secondary windings.

6. The resonant high current density transformer with an improved structure of claim 1, wherein the secondary windings are copper plates bent at either ends.

7. The resonant high current density transformer with an improved structure of claim 1, wherein the number of the plurality of sleeves of the insulating sheath equals the number of the first secondary core columns and the second secondary core columns.

8. The resonant high current density transformer with an improved structure of claim 1, wherein the secondary insulating bobbin and the primary insulating bobbin are coupled by a coupling mechanism.

9. The resonant high current density transformer with an improved structure of claim 1, wherein the coupling mechanism includes a securing clip that is assembled across the core assembly, and a connecting portion and a matching portion provided opposite to each other on the secondary insulating bobbin and the primary insulating bobbin, respectively.

10. The resonant high current density transformer with an improved structure of claim 1, wherein a ring piece is provided on either end of the primary insulating bobbin, and one or more partitioning ring pieces are provided on the surface of the primary insulating bobbin between the two ring pieces.

11. The resonant high current density transformer with an improved structure of claim 10, wherein a fastening strip extends from either side of the insulating cover and is fastened between one of the ring pieces and one of the partitioning ring pieces.

* * * * *